United States Patent [19]

Davis

[11] 4,150,913

[45] Apr. 24, 1979

[54] BLOWER FOR INDUSTRIAL VACUUM MACHINE

[76] Inventor: Henry J. Davis, 350 N. Edison St., Stockton, Calif. 95203

[21] Appl. No.: 830,021

[22] Filed: Sep. 2, 1977

[51] Int. Cl.[2] ..... F04D 24/28; F04D 29/66

[52] U.S. Cl. ..... 415/119; 415/213 B; 416/186 R

[58] Field of Search ..... 415/119, 204, 206, 213 B; 416/180, 182, 185, 188, 186 R, 186 A

[56] References Cited

U.S. PATENT DOCUMENTS

| | | | |
|---|---|---|---|
| 1,072,549 | 9/1913 | Williams | 416/186 R |
| 2,285,266 | 6/1942 | Fullemann | 415/204 |
| 2,327,810 | 8/1943 | McAnerney | 415/119 |
| 2,876,946 | 3/1959 | Hornschuch | 415/206 |
| 3,059,833 | 10/1962 | Benoit | 416/186 |

*Primary Examiner*—Louis J. Casaregola
*Attorney, Agent, or Firm*—Julian Caplan

[57] ABSTRACT

An improvement on Patent 3,651,621 has a blower construction using an impeller with backward curved blades for flow stability and high efficiency under varying conditions. The construction also resists the high stresses imposed by high speed and high flow velocities. A muffler for the discharge of the blower is provided.

2 Claims, 6 Drawing Figures

BLOWER FOR INDUSTRIAL VACUUM MACHINE

This invention relates to a new and improved blower system for industrial vacuum machines. In prior U.S. Pat. No. 3,651,621 certain advantages of the machine described therein over the prior art are set forth. It has been found that in addition to extracting dirt from holes, the machine has great commercial advantage in cleaning streets and highways, industrial plants of various kinds, sewer catch basins, railway cars, areas where sandblasting has been performed and many other locations. The advantages set forth in U.S. Pat. No. 3,651,621 are maintained in the present invention as well as additional advantages hereinafter set forth.

The present invention involves improved construction of the blower used in the machine of the present invention. One improvement in the blower construction is in the construction of the impeller which may be cast of a metal such as aluminum. The structure of the impeller hereinafter described provides high resistance to stress of rotation and to flow velocity through the blower.

In addition, the impeller comprises a plurality of blades of a particular shape having a backward slant which greatly improves the efficiency of the blower.

Still further, a muffler chamber is disposed to receive the discharge of the impeller and reduces the noise occurring from operation of the machine.

In the preferred embodiment illustrated, a vehicle-mounted machine is used, but the machine may be stationary. A motor-driven blower has its intake connected to a body or casing so as to create a vacuum within the casing. At the end of the casing opposite the blower is a hose which picks up debris and draws the debris into baffled compartments and then to a filter chamber where the air is filtered. The blower communicates with the filter chamber. The machine therefore separates out debris of various kinds, namely heavy particles, medium particles and fines. The present invention relates particularly to the blower and muffler therefor.

Other objects of the present invention will become apparent upon reading the following specification and referring to the accompanying drawings in which similar characters of reference represent corresponding parts in each of the several views.

Figure 1:
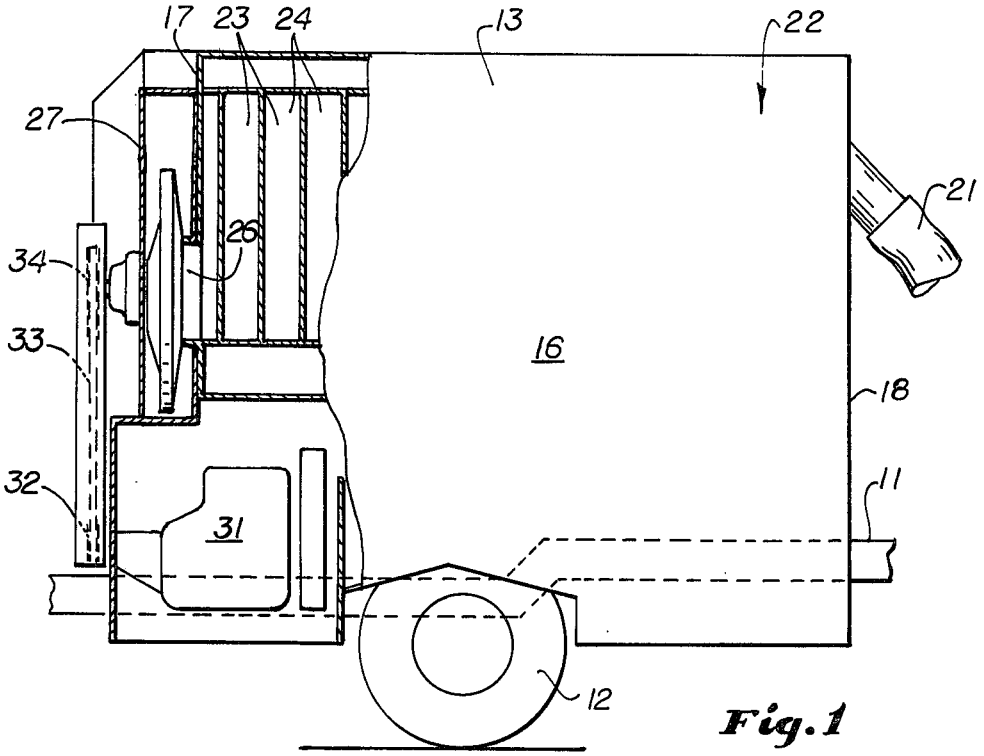
FIG. 1 is a side elevational view of a machine in accordance with the present invention broken away to reveal internal construction.
Figure 5:
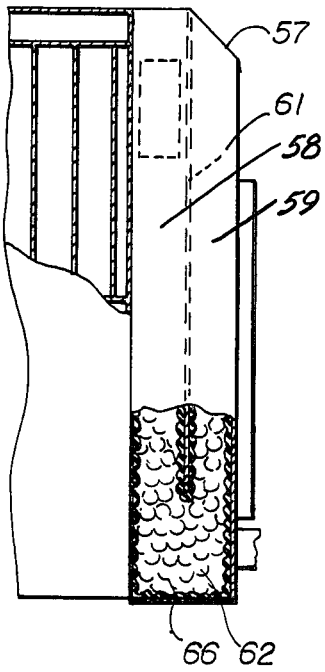
FIG. 5 is a side elevational view broken away in section of a portion of the structure of FIG. 4.
Figure 4:
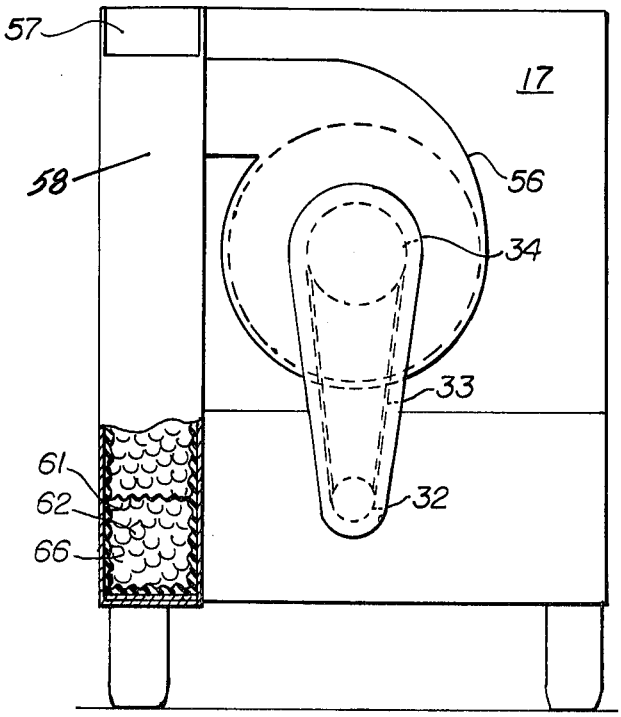
FIG. 4 is a rear view of the structure of FIG. 1.
Figure 2:
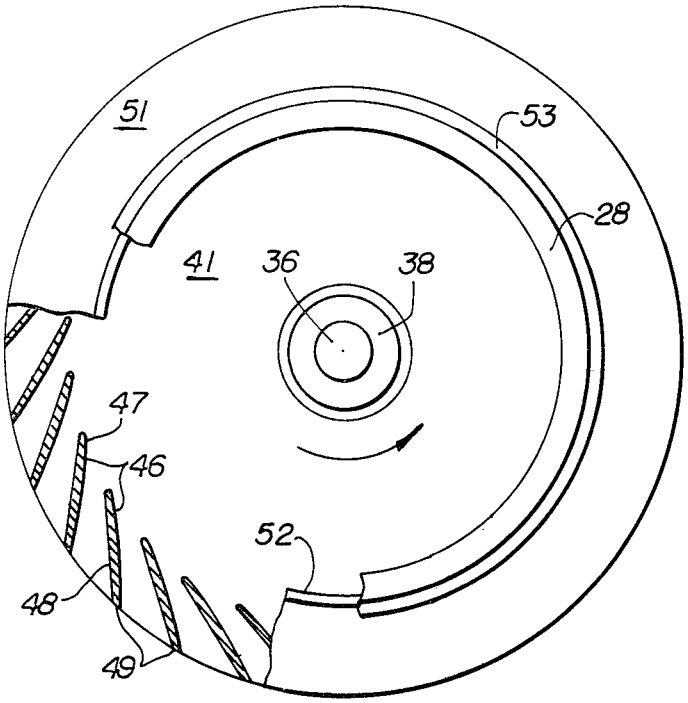
FIG. 2 is an end elevational view of a blower in accordance with the present invention broken away to reveal internal construction.
Figure 3:
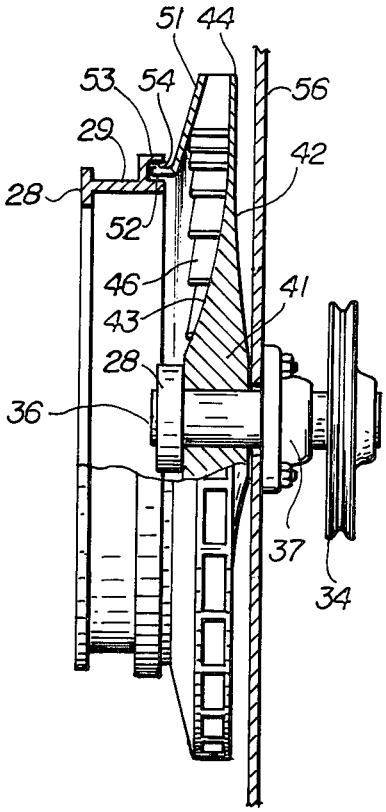
FIG. 3 is a side elevational view of the structure of FIG. 2 broken away to reveal internal construction.

As the machine shown in FIGS. 1 and 4 resembles in many details that of U.S. Pat. No. 3,651,621, many of the details of construction of the prior patent are not illustrated in detail nor described herein. As stated above, the machine may be stationary. In the illustrated embodiment there is provided a chassis 11 supported by wheels 12. Mounted on the chassis 11 is a body 13 having a top 14, sides 16, and back 17. From the front 18 extends a flexible hose 21 having a nozzle (not shown) at its distal end used to pick up debris. In the front of the body 13 is a forward compartment not herein illustrated but resembling the structure of the prior patent. In the rear of the body 13 is a filter chamber 23 having a plurality of fabric filters 24 supported therein as described in the prior patent. The outlet 26 of filter chamber 23 connects to blower compartment 27 which is directly within the back 17 of body 13. Outlet 26 discharges into a collar 28 (see FIGS. 2 and 3), the collar 28 having a cylindrical portion 29.

Mounted on body 13 is an engine 31 (or other prime mover) or a take-off from the vehicle motor may be used. Engine 31 has a pulley 32 driving a belt 33 which in turn drives pulley 34 which turns the shaft 36 of the blower hereinafter described. The rear of the shaft 36 is supported by a bearing 37 which is in turn supported by means not shown from the vehicle itself. The forward end of the shaft 36 has a forward hub 38.

Fixed for a rotation with shaft 36 is the body 41 of the impeller. Directing attention particularly to FIG. 3, body 41 has a rear face 42 which narrows forwardly and proceeds substantially radially outwardly relatively to shaft 36. The forward face 43 of body 41 tapers rearwardly-outwardly so that the thickness of body 41 adjacent outer terminus 44 is relatively thin, thereby reducing the weight of the structure. Extending inward from the terminus 44 is a plurality of blades 46 here shown as thirty, equi-angularly spaced.

Figure 6:
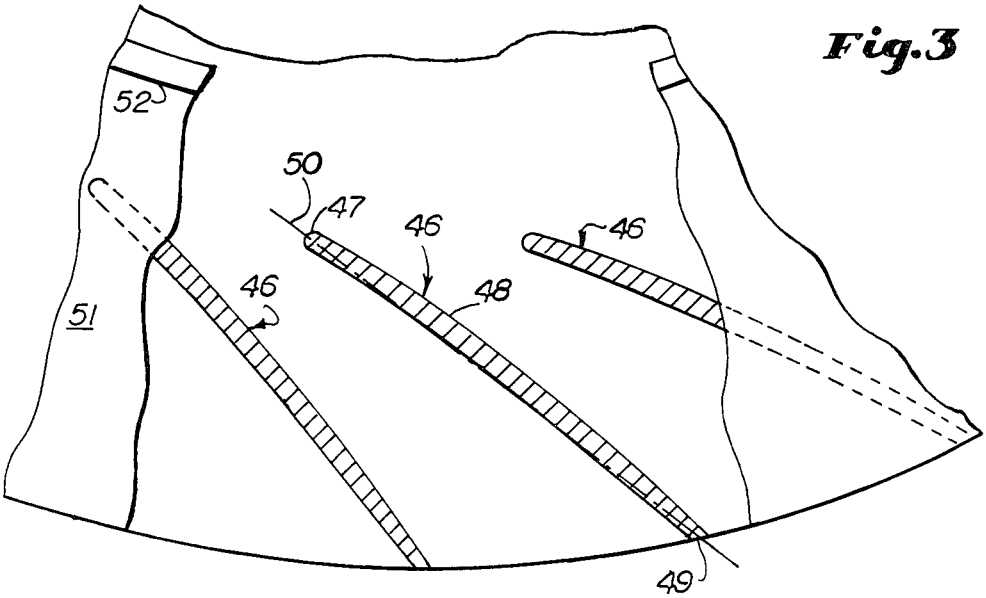
FIG. 6 is an enlarged somewhat schematic sectional view through one of the blades of the impeller.

The blades 46 are disposed substantially perpendicularly to a radial plane. The inner end 47 of each blade 46 is located slightly outward of cylindrical portion 29 of collar 28 and angles outwardly-forwardly relative to the direction of rotation of the impeller so that the outer end 49 is approximately 18° in advance of the inner end 47. The inner and outer ends 47, 49 are approximately the same thickness while the thickness of the blade at the midpoint 48 is approximately 25% greater than at either end. The blade 46 curves forwardly as best shown in FIG. 6. In other words, if a line indicated by reference numeral 50 were drawn between the ends 47, 49 of blade 46, the blade 46 itself is forwardly of line 50 in the direction of rotation and the blade 46 is curved relatively to line 50. This provide maximum flow stability and high efficiency at various rates of flow.

Annular forward face 51 of the impeller slants inwardly-forwardly (see FIG. 3) and terminates in a forward directed small cylindrical flange 52 which fits within a groove 54 in the enlarged rearward end 53 of the cylindrical portion 29 of collar 28. Thus air entering from the outlet 26 of the filter chamber is conducted by the collar 28 between the blades 46 of the impeller and forced outward by rotation of the impeller into the scroll 56 which surrounds the impeller.

Directing attention now to FIG. 4, the outlet 57 of the scroll 56 discharges into the upper end of the forward portion of the muffler chamber 58 which is located on the left side of the rear of the body 13. As shown in FIG. 4, the outlet 57 is preferably at the top. Immediately rearward of muffler chamber 58 is a rearward extension 59, there being a vertical partition 61 between chambers 58 and 59 with a gap or opening 62 at the bottom of the partition 61. Thus the flow from scroll outlet 57 is downward in the forward muffler compartment 58, then rearwardly through gap 62 and then up through the rearward extension 59 and out to the atmosphere. Preferably, to deaden the noise, sound deadening material 66 lines the compartments 58 and 66, this being a polyurethane packing material of the type used for protection of parcels against breakage and having a plurality of bubbles incorporated in the foam.

What is claimed is:

1. A blower comprising a scroll casing, an impeller inside said scroll having a hub, means for rotating said hub, said impeller having a body having a rear face and a forward face, said forward face in cross-section curving rearwardly-outwardly and then radially outward relative to the axis of said hub, a plurality of equiangularly spaced blades extending approximately perpendicularly forward from said forward face and an annular forward member forward of said blades having a flat planar rearward face slanting forwardly-inwardly from the periphery of said impeller and terminating in a forward directed, substantially cylindrical flange, a stationary collar mating with said flange to direct air rearward between said blades, each said blade extending from an inner terminus spaced outward of said collar to an outer terminus at the periphery of said impeller, each said blade slanting forward-outwardly in the direction of rotation of said impeller and curving in a concave-convex shape relative to a base line between the inner and outer terminus, said blade being spaced forward of said base line in said direction of rotation, the thickness of said blade being about 25% greater midway of the distance between said termini than at either terminus, said blades overlapping, the angle between lines tangent to the forward faces of said blades adjacent said inner termini being about 50% less than the angle between lines taught to the forward faces of said blades adjacent said outer termini.

2. A blower according to claim 1 which further comprises a vertically disposed muffler chamber having narrow, vertically elongated side, front and back and a vertical partition dividing said chamber into two parts, said scroll discharging into a first end of a first part, the second end of said second part opposite said first end discharging into the atmosphere, the interior of said chamber being lined with a sound deadening material consisting of a sheet of polyurethane plastic formed with pluralities of bubbles integrally formed in said sheet, said bubbles facing inward of said muffler chamber so that air passing through said chamber blows over said bubbles and sounds are deadened.

* * * * *